US007606525B2

(12) United States Patent
Lee

(10) Patent No.: US 7,606,525 B2
(45) Date of Patent: Oct. 20, 2009

(54) BROADCASTING RECEIVER AND METHOD THEREOF

(75) Inventor: Hye Jin Lee, Anyang-si (KR)

(73) Assignee: LG Electronics Inc., Seoul (KR)

( * ) Notice: Subject to any disclaimer, the term of this patent is extended or adjusted under 35 U.S.C. 154(b) by 564 days.

(21) Appl. No.: 11/533,337

(22) Filed: Sep. 19, 2006

(65) Prior Publication Data

US 2007/0118856 A1 May 24, 2007

(30) Foreign Application Priority Data

Nov. 21, 2005 (KR) ..... 10-2005-0111452

(51) Int. Cl.
*H04H 1/00* (2006.01)

(52) U.S. Cl. ..... 455/3.01; 455/3.06; 455/457; 701/207; 701/209; 701/210; 340/988; 340/995.23

(58) Field of Classification Search ..... 455/556.1, 455/432.1, 418–420, 3.01, 3.06, 344, 345, 455/457, 557; 701/200, 201, 204, 202, 207–211, 701/213; 340/990, 905, 988, 995.1, 993, 340/995.27, 995.13, 995.23; 342/357.01, 342/357.1, 357.13, 357.17, 457, 357.09, 342/357.08

See application file for complete search history.

(56) References Cited

U.S. PATENT DOCUMENTS

| | | | | |
|---|---|---|---|---|
| 6,085,146 | A * | 7/2000 | Kuribayashi et al. | 701/200 |
| 6,338,020 | B2 * | 1/2002 | Hashimoto | 701/208 |
| 6,484,093 | B1 * | 11/2002 | Ito et al. | 701/211 |
| 7,184,886 | B1 * | 2/2007 | Krull et al. | 701/209 |
| 7,269,508 | B1 * | 9/2007 | Childs et al. | 701/211 |
| 7,305,302 | B2 * | 12/2007 | Kaplan | 701/208 |
| 7,412,327 | B2 * | 8/2008 | Kauvo et al. | 701/209 |
| 7,493,213 | B2 * | 2/2009 | Lee et al. | 701/209 |
| 2002/0040271 | A1 * | 4/2002 | Park et al. | 701/209 |
| 2007/0225902 | A1 * | 9/2007 | Gretton et al. | 701/202 |

* cited by examiner

*Primary Examiner*—Sujatha Sharma
(74) *Attorney, Agent, or Firm*—Fish & Richardson P.C.

(57) ABSTRACT

Digital broadcasting content is viewed by a user, such as through a portable terminal having a broadcasting receiver configured to receive digital broadcasting content. An original travel path is obtained based on a travel destination. The portable terminal determines if a broadcasting blind zone exists relative to the original travel path. If the broadcasting blind zone or zones exist, the portable terminal provides navigation instructions for a modified travel path which avoids the broadcasting blind zones.

33 Claims, 4 Drawing Sheets

BROADCASTING RECEIVER AND METHOD THEREOF

BACKGROUND

This description relates to a broadcasting receiver for supporting a broadcasting service through a portable terminal.

Mobile multimedia broadcasting includes broadcasting or transmitting television broadcasting, radio broadcasting, and/or data broadcasting using a multichannel with the primary purpose of receiving broadcast material in a portable terminal. The mobile multimedia broadcasting is realized as digital audio broadcasting (DAB) in Europe, digital audio radio (DAR) in the United States, digital radio broadcasting (DRB) in Canada, ground wave digital audio broadcasting in Japan, digital multimedia broadcasting (DMB) in Korea, and digital sound broadcasting (digital satellite radio) (DSR) in International Telecommunication Union (ITU)-R. These mobile multimedia broadcasting systems also provide digital voice service.

Based on digital voice service, technology development has made it possible to convey more data in limited bandwidth. Accordingly, it is possible to transmit moving image data in the form of compact disk (CD)-level, digital versatile disk (DVD)-level, and as voice data.

DMB and other multimedia broadcasting techniques may include ground wave digital multimedia broadcasting and/or satellite digital multimedia broadcasting. DMB include broadcasting services allowing a user to view various multimedia broadcasting through a multi-channel while moving using a personal digital assistant (PDA) or a receiver for an automobile.

Digital broadcasting is rapidly proceeding through the existing media, such as ground waves, satellites, cable TV broadcasting. Digital multimedia broadcasting is changing the broadcasting industry environment and is emerging in response to a trend toward the integration of digital broadcasting with communication among various other media. One of the significant characteristics of the DMB service is the ability to view digital television broadcasting while moving.

The DMB service may be implemented by integrating DMB with a portable terminal supporting a communication function. The portable terminal may include a cellular phone, a PDA, a portable computer, and/or an MPEG layer 3 (MP3) player.

A user may mount the portable terminal on a moving object, such as a vehicle and view broadcast material, and/or a user may carry the portable terminal and view broadcast material while moving. In either case, a blind zone (silent zone) may exist where reception of information is difficult or impeded, for example, due to the influence of tall buildings and/or geographic features in a neighborhood surrounding the user's position. Accordingly, a user may not receive reliable and/or complete broadcasting of data while in or near such a blind zone.

SUMMARY

In one general aspect, a broadcasting receiver permits a user to constantly receive broadcasting service through a portable, mobile terminal.

In another general aspect, a broadcasting receiver is capable of recognizing in advance movement relative to a surrounding or nearby blind zone situated along a travel path of a portable terminal. The user may be able to bypass a blind zone or choose an alternate path better supported by available broadcasting service.

In one general aspect, receiving broadcasting content includes viewing digital broadcasting content. An original travel path is obtained based on a travel destination and the existence of a broadcasting blind zone relative to the original travel path is determined. If the broadcasting blind zone exists, navigation instructions are provided for a modified travel path avoiding the broadcasting blind zone.

Implementations may include one or more of the following features. For example, navigation instructions may be provided for a modified travel path to a user through a portable terminal.

Position information relating to the broadcasting blind zone may be compared with position information of the original travel path to determine if the broadcasting blind zone exists. The position information relating to the broadcasting blind zone may be stored in a memory of a portable terminal, or may be downloaded from an external source to a portable terminal.

The blind zone information may include broadcasting channel information or broadcasting station information. The blind zone information also may include position information relating to the broadcasting blind zone for each broadcasting channel or for each broadcasting station.

A user may be informed of one or more broadcasting blind zones.

The viewing of digital broadcasting content may include viewing digital multimedia broadcasting signals transmitted through a satellite, digital multimedia broadcasting signals transmitted through ground waves, and/or broadcasting signals transmitted through digital television broadcasting.

The viewing of digital broadcasting content may include viewing a predetermined channel.

In another general aspect, receiving broadcasting content includes viewing digital broadcasting content. An original travel path is obtained based on a travel destination. The presence of a broadcasting blind zone existing relative to the original travel path is determined, and if the broadcasting blind zone exists, the original travel path is selected or a modified path is selected that does not include the broadcasting blind zone as a selected travel path. Navigation data is provided based on the selected travel path.

Implementations may include one or more of the following features. For example, position information relating to the broadcasting blind zone may be compared with position information of the original travel path to determine if the broadcasting blind zone exists.

The position information relating to the broadcasting blind zone may be stored in a memory of a portable terminal, or may be downloaded from an external source to the portable terminal. Voice service also may be provided through the portable terminal.

Audio or visual navigation instructions relating to the navigation data may be provided to a user.

The blind zone information may include broadcasting channel information or broadcasting station information. The blind zone information also may include position information relating to the broadcasting blind zone for each broadcasting channel or for each broadcasting station.

A user may be informed of one or more broadcasting blind zones.

The viewing of digital broadcasting content may include viewing digital multimedia broadcasting signals transmitted through a satellite, digital multimedia broadcasting signals transmitted through ground waves, or broadcasting signals transmitted through digital television broadcasting.

The selection of the original travel path or the modified path may include prompting a user to select the original travel path or the modified travel path. Alternatively, the selection of the original travel path or the modified path may include having a portable terminal automatically select the original travel path or the modified travel path.

In another general aspect, a portable terminal includes a broadcasting receiver configured to receive and decode digital broadcasting content, a position information receiver configured to receive position information, a mapping unit configured to store map information, a video and audio processor configured to process a video signal and an audio signal, and a display device for displaying digital broadcasting content based on the video signal. The portable terminal includes an audio output device configured to output broadcast content based on the voice signal, a memory part for storing broadcasting blind zone information, and a navigation part. The navigation part is configured to determine if a broadcasting blind zone exists on a navigation basic path while a user views the digital broadcasting content, and to provide navigation instructions for a travel path that avoids a broadcasting blind zone.

Implementations may include one or more of the following features. For example, the memory part may include a detachable memory device or a built-in memory device.

The portable terminal may include a radio part configured to provide wireless Internet access.

The mapping unit may include blind zone information, the blind zone information including broadcasting channel information or broadcasting station information. The blind zone information may further include position information relating to any blind zones for each broadcasting channel or each broadcasting station.

The navigation part may be configured to perform navigation by providing voice instructions relative to a travel path and provided to a user viewing broadcasted content.

The broadcasting receiver may be configured to receive signals from digital multimedia broadcasting transmitted through a satellite digital multimedia broadcasting transmitted through ground waves, or digital television broadcasting.

The navigation part may be configured to determine if the broadcasting blind zone exists for a predetermined channel and while the predetermined channel is viewed by a user.

The navigation part may be configured to determine if the broadcasting blind zone exists relative to a travel path by comparing position information contained in the blind zone information stored in the memory part with position information relating to the travel path.

The navigation part may be configured to provide at least one modified travel path enabling the receipt of digital broadcasting without the broadcasting blind zone.

The navigation part may be configured to prompt a user to select an original travel path or a modified travel path avoiding an existing broadcasting blind zone.

Other features will be apparent from the following description, including the drawings, and the claims.

DETAILED DESCRIPTION

Figure 1:
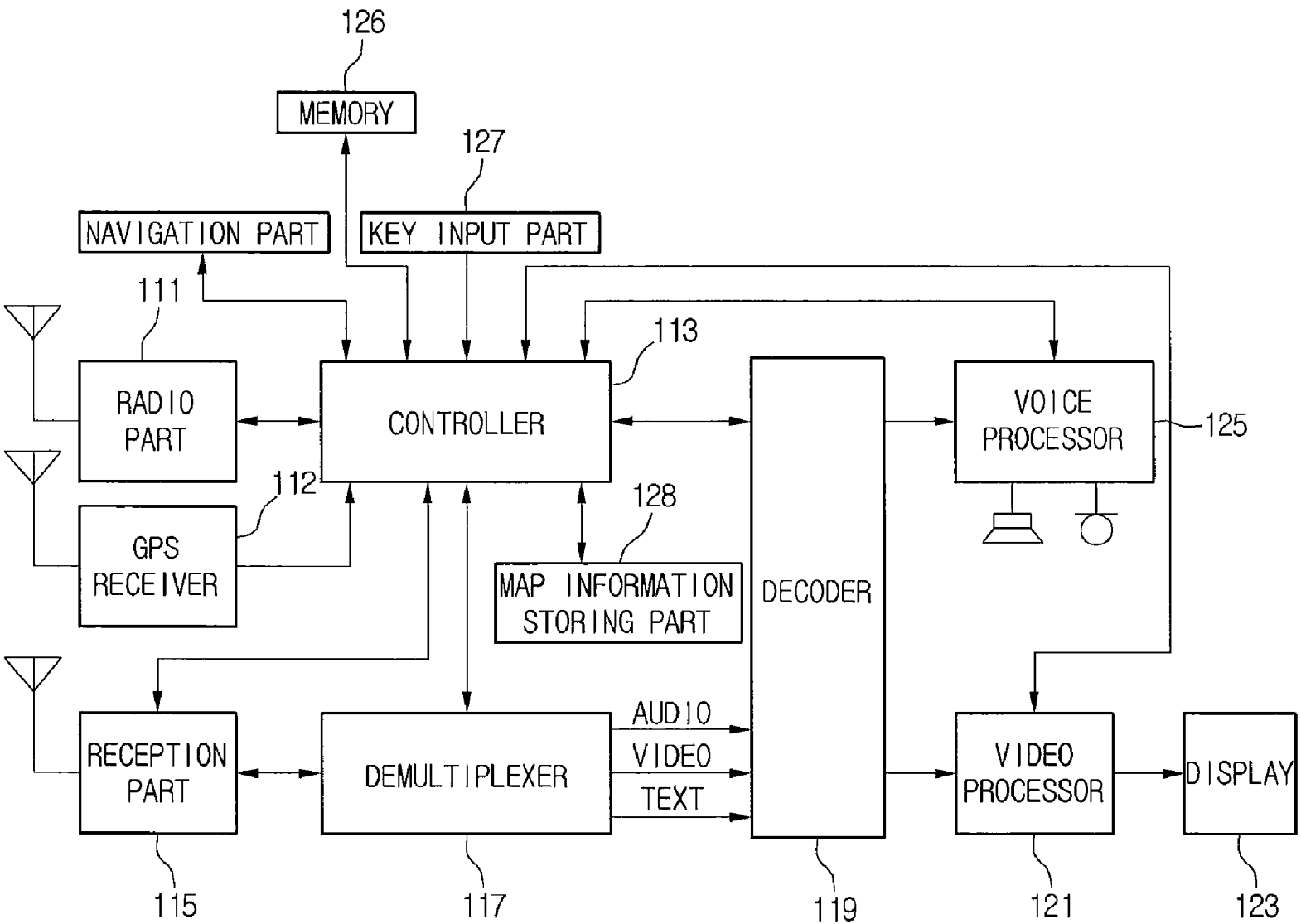
FIG. 1 is a view of a portable terminal for receiving broadcasting.

Referring to FIG. 1, a portable (mobile) terminal can receive digital multimedia signals in which compression-coded audio/video signals are multiplexed and transmitted. The mobile terminal includes: a radio part 111 for receiving radio signals for voice communication and for converting the radio signals into coded signals. The terminal also includes a global positioning system (GPS) receiver 112 for receiving position data from one or more GPS satellites, and a controller 113 for controlling a system. A reception part 115 is provided for receiving digital multimedia broadcasting signals, and a demultiplexer 117 is provided for separating the multiplexed audio/video signals from the digital multimedia broadcasting signals. The terminal includes a decoder 119 for decoding the separated audio/video signals and providing the decoded audio signals and video signals to a speaker and a display 123, respectively, a video processor 121 for processing and outputting video signals to the display 123, and a voice processor 125 for converting the coded signals into electrical voice signals and outputting the same to the speaker. A memory 126 is provided for storing blind zone information.

The terminal includes a key input part 127, a map information storing part 128 for providing map data for a travel path of a moving object, and a navigation part 129 for guiding the travel path of the moving object using position data and the map data. The travel path may be input from the key input part 127.

In operation, the radio part 111 converts radio signals received from an antenna ANT into predetermined signals and delivers the converted signals to the controller 113 or the voice processor 125 under control of the controller 113. The radio part 111 also converts coded signals received from the voice processor 125 into signals of a band used in transmitting in radio signals and outputs the same to the antenna ANT. Signals output to the controller 113 from the radio part 111 may be pilot signals and paging signals from a base station, data received during data communication, or messages received from the base station to the mobile terminal for power control. The controller 113 delivers call set data, power control data, or data to be transmitted during data transmission to the radio part 111, thereby transmitting those data to the base station.

Accordingly, signals output from the radio part 111 to the voice processor 125 may be coded audio signals received after a call is set. The GPS receiver 112 receives position data from one or more GPS satellites.

The controller 113 controls the overall operations of the portable terminal. Specifically, the controller 113 controls the individual parts and components to provide navigation service together with viewing of the digital multimedia broadcasting.

The reception part 115 receives digital multimedia broadcast signals containing multiplexed video signals, audio signals, and additional signals. The video signals, the audio signals, and the additional signals are compression-coded using separate packets, respectively, and then multiplexed and transmitted. The video signals and the audio signals may be compression-coded using a general compression method such as H.264 (MPEG4 p. 10) or MPEG-4 AAC. The additional signals include text signals (e.g., caption data) associated with video signals and audio signals.

The digital multimedia signals may be digital multimedia broadcasting signals transmitted from a satellite. Also, the digital multimedia signals may be digital multimedia data stream broadcasting signals, video on demand (VOD), music on demand (MOD), or audio on demand (AOD) signals. The following description will be based on digital multimedia broadcasting signals. However, it will be appreciated that other digital multimedia signals may be used instead of digital multimedia broadcasting signals.

The reception part 115 amplifies the low noise component of the received digital multimedia signals and then converts the amplified signal into intermediate frequency (IF) signals. The IF signals are spectrum-despread by a spreading code that corresponds to a reception channel designated through the key input part 127 by a user. The despread channel signals are demodulated by a demodulator (not shown). The demodulated channel signals are input to the demultiplexer 117. The demultiplexer 117 separates the demodulated channel signals from the reception part 115 into audio signals, video signals, and text signals. The separated audio signals, video signals, and text signals are inputted to the decoder 119.

The decoder 119 includes an audio decoding unit, a video decoding unit, and an additional signal decoding unit. The audio decoding unit (not shown) decodes the coded audio signals and outputs the decoded audio signals to the voice processor 125. The video decoding unit decodes the coded video signals and outputs the decoded video signals to the video processor 121, which controls the display 123. The additional signal decoding unit decodes additional signals containing text signals and outputs the decoded text signals together with the video signals to the display 123 via the video processor 121.

The text signals may be controlled to control whether text is displayed on the display 123 under control of the controller 113 and based on the selection of a user. The decoder 119 also decodes multimedia signals, such as moving images and music stored in advance in the memory 126.

The voice processor 125 includes a voice codec for converting coded audio signals from the radio part 111 into electrical voice signals to output the same through the speaker or for coding electrical voice signals received from a microphone (MIC) to deliver the electrical voice signals to the radio part 111. Also, the voice processor 125 may include a stereo codec for converting decoded audio signals from the audio decoding unit of the decoder 119 into stereo audio signals.

The video processor 121 converts decoded video signals from the video decoding unit of the decoder 119 into screen data to be displayed on the display 123, and provides the screen data to the display 123. The display 123 displays an image on a screen using video signals outputted from the video processor 121, and displays user data outputted from the controller 113.

A user carrying the portable terminal can select a broadcasting channel using the reception part 115 and view broadcasting of the selected channel using the speaker and the display 123 through the demultiplexer 117, the decoder 119, the video processor 121, and the voice processor 125.

The memory 127 has blind zone information in the form of a table. The memory 127 may be a built-in memory or a separate detachable memory. In the case where the memory 127 is a detachable memory, the blind zone table may be updated through a personal computer (PC), such as through patches or downloads. In the case where the memory 127 is a built-in memory, the mobile terminal may access the wireless Internet using the radio part 111 to download the blind zone table, or may download the blind zone table using a connection through a serial interface, such as through a universal serial bus (USB) or other serial interface.

The blind zone table includes a broadcasting channel number, broadcasting station information, position information and/or zone information for the blind zone.

The key input part 127 has a key matrix structure and includes numerical keys for dialing and function keys for performing a variety of functions. The key input part 127 generates a key signal that corresponds to a key input by a user and provides the key signal to the controller 113. Also, the key input part 127 includes a separate function key or a multi-function key for receiving digital multimedia data and a voice communication request. The key input part 127 may be realized in the form of a touch pad or a visual keyboard.

A user may directly select or input a travel path using the key input part 127. The map information storing part 128 may store map information data using a large-capacity memory device or may be mounted in a disk medium as a drive. The map information storing part 128 includes coordinate data and map data that correspond to position data of the portable terminal.

The navigation part 129 provides a travel path of a moving object using the position data of the moving object received from the GPS receiver and the map information stored in the map information storing part 128 through the display 123. The navigation part 129 receives satellite signals from GPS satellites orbiting the earth using the GPS receiver 112, and senses the current position and the direction of travel of the moving object, i.e., the portable terminal, under control of the controller 113. The traveling trajectory of the moving object may be tracked and estimated based on the current position and the direction of travel. Since a user can reach a destination through a variety of traveling paths starting from a departure point, the navigation part 129 may provide a shortest path to a user of the portable terminal. The direction of travel and a traveling speed may be detected using a gyroscope and a speed sensor provided in the moving object or a device, e.g., a vehicle, in which the moving object is mounted.

When used in a vehicle, the navigation part 129 traces the position of the moving vehicle while traveling to accurately display the position on a road map and to provide a variety of useful information, such as traffic conditions relating to a road along a projected travel path and locations of points of interest, such as gas stations, restaurants, and government and/or public offices.

If a destination is input by the user, the navigation part 129 explores travel paths of the portable terminal on the basis of the map information stored in the map information storing part 128 with consideration of the current position and the traveling direction. After exploring the travel paths of the portable terminal, the navigation part 129 provides navigation service using a finally selected travel path.

The portable terminal determines if broadcasting is currently viewed by a user. If the broadcasting is being viewed by the user, the blind zone table is read from the memory 126 and applicable blind zones, if any, are detected relative to the travel path. If one or more blind zones exist on the travel path, a travel path excluding or avoiding the blind zone is extracted to ensure reliable broadcasting is provided throughout the travel path in conjunction with navigation information. Since a user views the broadcasting through the display, the navigation may be provided using voices and/or text instructions.

The portable terminal may view broadcasting and perform a navigation function with the use of only the GPS receiver and an element for receiving the digital broadcasting. Accordingly, broadcasting may be accomplished even without the radio part that would enable wireless Internet and/or wireless communication capabilities.

The portable terminal may store the blind zone information in the memory in advance, or may download the blind zone information from a web server or otherwise to receive information as to whether the blind zone exists on the travel path, to receive position information of the blind zone, and/or to perform navigation instructions for proceeding along a new travel path. The blind zone (or blind band) may be different for each broadcasting channel or each broadcasting station. In addition, the degree of reception of broadcasting signals may vary depending on local characteristics, such as topography or man-made structures.

Figure 2:
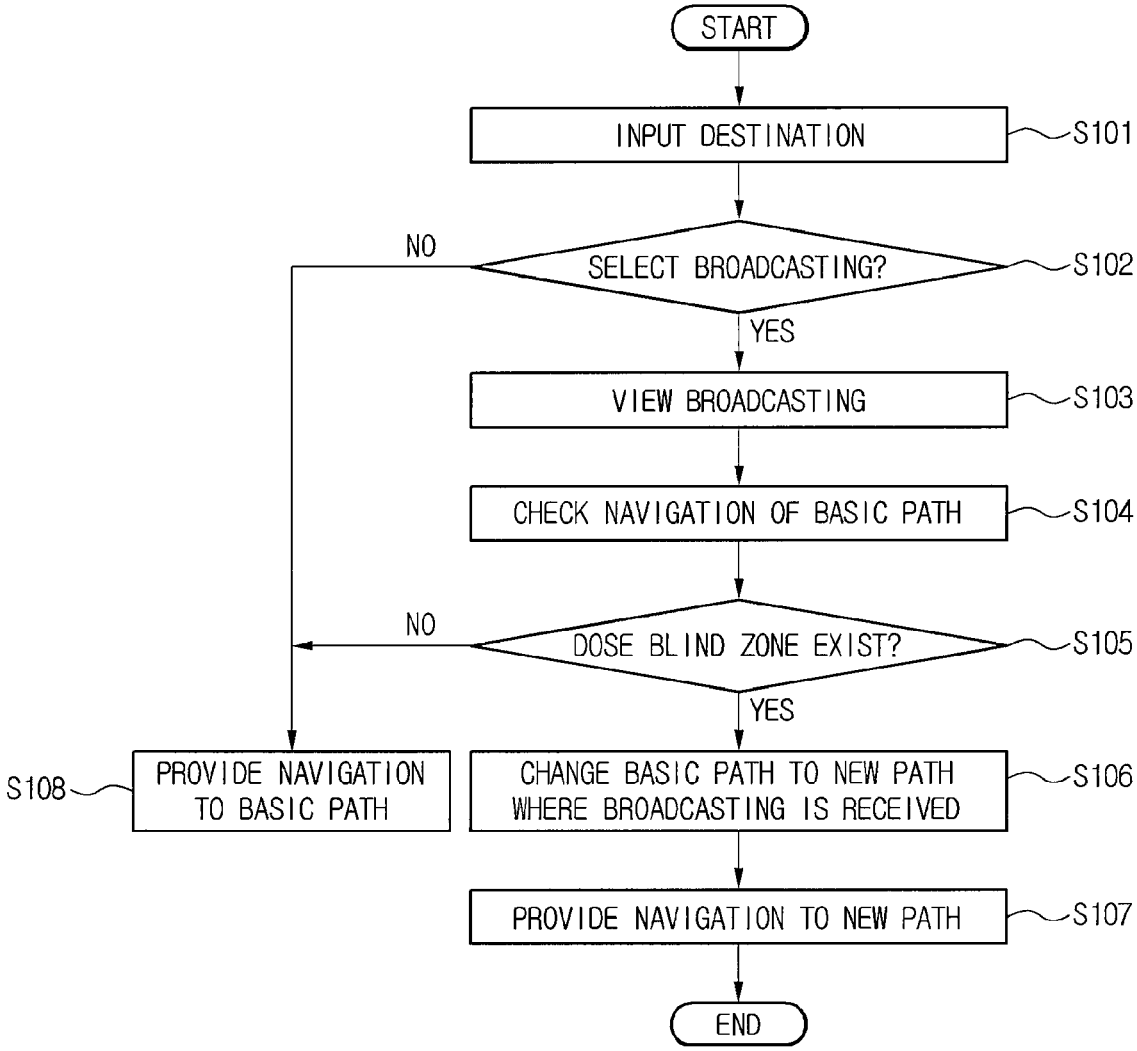
FIG. 2 is a flowchart of a method for receiving broadcasting in a portable terminal.

Referring to FIG. 2, if a user of the portable terminal inputs a destination using a key input part (S101), a basic travel path (basic path) is traced by the terminal. A user, or the terminal, checks if a broadcasting selection for broadcasting viewing is made (S102). If the broadcasting selection has not been made by a user, navigation instructions are provided for the traced basic path (S108).

However, if the viewing of broadcasting is selected by the broadcasting selection (S103), navigation instructions for the traced basic path are checked (S104) and any blind zone(s) are identified (S105). For example, the terminal may compare a blind zone table stored in a memory with codes contained in the basic path, and any blind zones are recognized if the zone or location having the same code exists within the zone table.

If the blind zone exists on the basic path as a result of operation S105, the blind zone of the basic path is changed into a zone where broadcasting is received and navigation instructions are provided for a changed travel path consistent with the changed zone (S107). If the blind zone does not exist on the basic path after operation S105, navigation instructions are provided for the basic path (S108).

Operation S102 relating to the broadcasting selection and/or the operation S101 relating to inputting the destination may be performed first or simultaneously. The travel path of the navigation may be changed according to the selected broadcasting service.

A navigation function uses a GPS and map information. Since the broadcasting viewing screen is currently displayed on the display, the navigation function is provided using voice prompts and/or text instructions. The navigation function may also be fully activated and the viewing of the broadcasting may be performed in the form of audio or text only provided optionally through the portable terminal.

Figure 3:
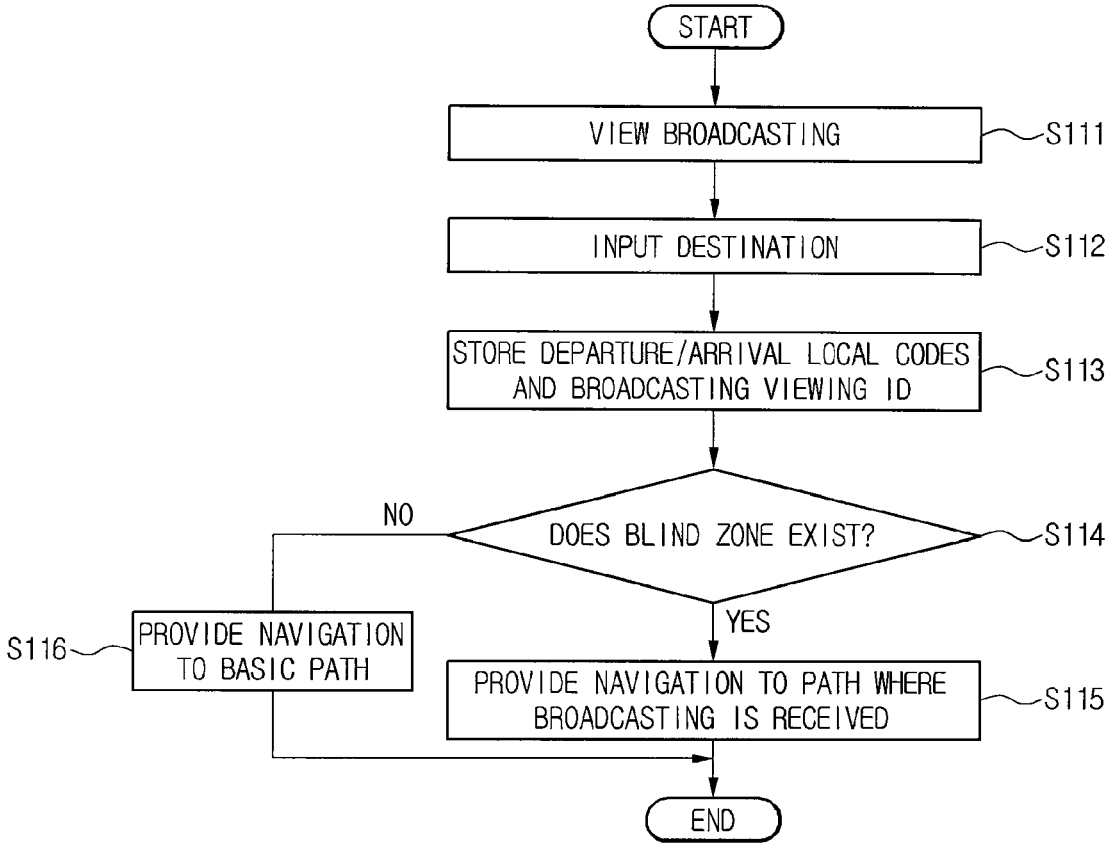
FIGS. 3 and 4 are flowcharts of processes for receiving broadcasting.

Referring to FIG. 3, if a destination is input by a user (S112) while broadcasting is viewed by a user (S111), a departure and/or arrival local code and a broadcasting viewing identification (ID) are stored (S113). The broadcasting viewing ID may be a broadcasting channel number or broadcasting station information. A travel path relative to map information is extracted using the departure and arrival local code or codes. A blind zone table is retrieved on the basis of the broadcasting viewing ID and based on the projected or inputted travel path.

If one or more blind zone exist on the travel path of the portable terminal (S114), the travel path is changed into a path containing a zone where broadcasting is received, and navigation instructions are provided for the new or modified travel path (S115). However, if blind zone or zones are not identified (S114), navigation instructions are provided for a default or original travel path (S116).

If the navigation function is provided while the broadcasting is being viewed, an altered or new travel path is obtained and provided to the user before the portable terminal actually passes through the blind zone, e.g., to provide the user with the opportunity to travel along the new travel path that excludes broadcasting blind zones. A point at which the path is changed into the new travel path may be determined using a predetermined or default distance from the blind zone as a reference, e.g., such as one quarter to one half mile before the blind zone is encountered. Alternatively, or in addition, the terminal may use an estimated time remaining until the blind zone is reached that is based on considerations of a current moving speed and heading as a reference.

Figure 4:
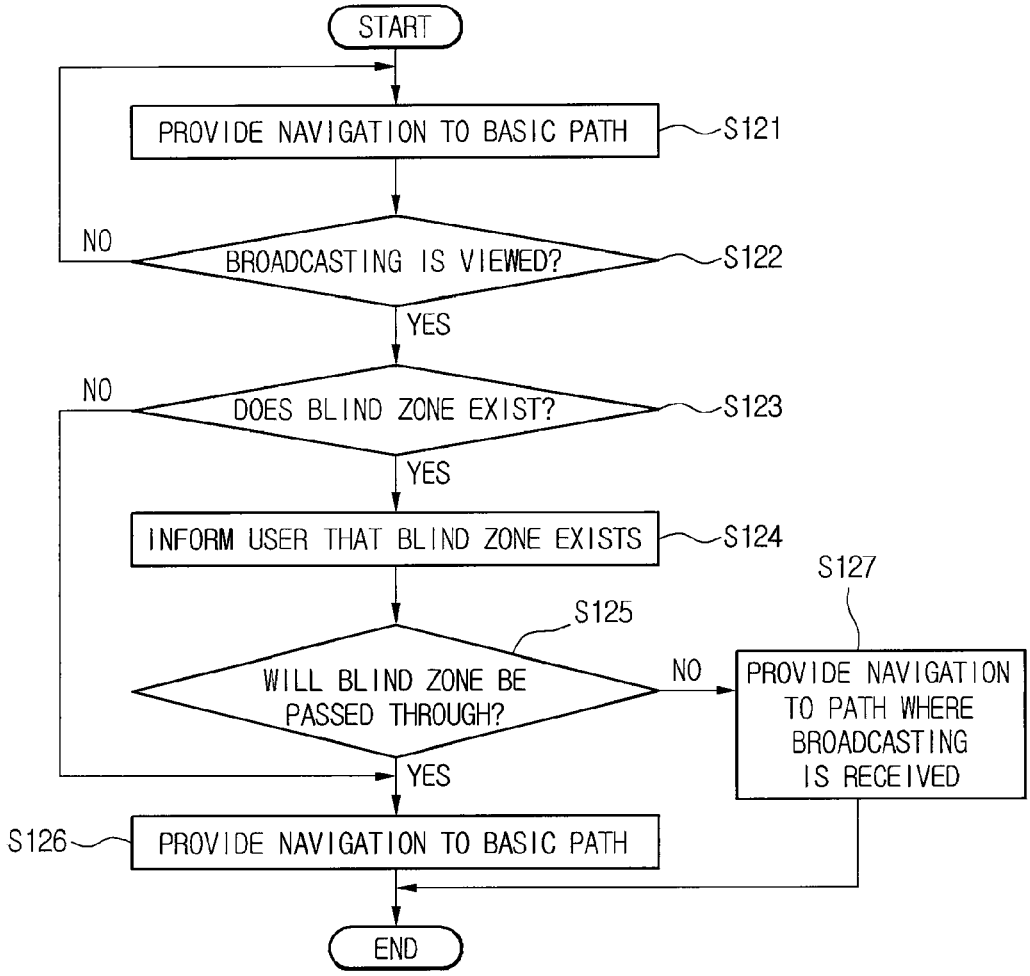

Referring to FIG. 4, navigation instructions are provided to a basic travel path (S121). Next, the terminal determines if a broadcasting viewing request has been input by a user (S122). If the broadcasting viewing request has been input by the user, the terminals determines if a blind zone or zones exist on the projected travel path (S123). If a blind zone or zones exist on the basic path, information relating to the blind zone is provided to the user (S124), and a user selects whether to pass through the blind zone or to avoid the blind zone (S125). If there are no blind zones, or a user opts to pass through the blind zone anyway, navigation instructions are provided for the basic (original) path (S126). In contrast, if a user opts to avoid the blind zone area, navigation instructions are provided for a new or modified travel path supported by satisfactory broadcasting reception zones (S127).

If a user intends to view broadcasting, the portable terminal may inform a user of the presence of a blind zone along the projected, current travel path and allow a user to select the current travel path or an alternative travel path from one or more different paths. Alternatively, a user is permitted to proceed along the original travel path (with the current navigation instructions) with the knowledge that a blind zone exists along the projected travel path. In addition, the basic or default path, or the new or modified selected travel paths may include primary considerations or settings, for example, the paths may be presented with navigation instructions providing the shortest or fastest travel route.

A broadcasting viewing channel in the portable terminal includes at least one broadcasting channel of multimedia broadcasting that uses a satellite or ground waves and digital television broadcasting. Also, the blind zone information in the portable terminal includes one or more of a table for satellite multimedia broadcasting, a table for satellite digital television broadcasting, a table for ground wave multimedia broadcasting, and/or a table for ground wave digital television broadcasting.

Therefore, the portable terminal provides a navigation function with preference given to optimizing broadcasting service to a user. If the original travel path is modified, a new path having a shortest travel distance or fastest travel time may be provided that also avoids the potential blind zone or zones.

While providing broadcasting viewing and the navigation function, the terminal may also prompt a user to select whether to receive broadcasting service for the blind zone or to alter the travel path. The terminal may prompt a user to select the current travel path (with blind zones) or an alternate travel path (with no or fewer blind zones) after determining that the user is within a predetermined time period or distance until the blind zone is encountered, thereby providing the user sufficient time to select an alternate travel route.

The terminal may automatically provide navigation instructions for a modified travel path that does not pass through the blind zone, and/or a modified travel path that encounters fewer blind zones, without waiting for the selection of a user and/or without prompting the user for a selection. In that case, preferred broadcasting channel information or travel routes may be stored in the memory.

The broadcasting receiver can be used to provide reliable broadcasting viewing through a portable terminal. The portable terminal may record broadcast content automatically through an internet protocol (IP) device existing on a network that may queue subject matter for subsequent download, e.g., after the terminal has passed through a blind zone, and the cached content may be forwarded to the user to continue viewing content at a point just prior to encountering the blind zone. Accordingly, the portable terminal allows a user to reliably access a network using an IP enabled device to operate other devices and to receive broadcasted content.

Various modifications, additions and substitutions are possible. Accordingly, other implementations are within the scope of the following claims.

What is claimed is:

1. A method for receiving broadcasting content, the method comprising:

viewing digital broadcasting content;

obtaining an original travel path based on a travel destination;

determining if a broadcasting blind zone exists relative to the original travel path; and if the broadcasting blind zone exists, providing navigation instructions for a modified travel path avoiding the broadcasting blind zone.

2. The method according to claim 1, wherein providing navigation instructions comprises providing navigation instructions for a modified travel path to a user through a portable terminal.

3. The method according to claim 1, wherein determining if the broadcasting blind zone exists comprises comparing position information relating to the broadcasting blind zone with position information of the original travel path.

4. The method according to claim 3, wherein the position information relating to the broadcasting blind zone is stored in a memory of a portable terminal.

5. The method according to claim 3, wherein the position information relating to the broadcasting blind zone is downloaded from an external source to a portable terminal.

6. The method according to claim 3, wherein the blind zone information comprises broadcasting channel information or broadcasting station information.

7. The method according to claim 6, wherein the blind zone information comprises position information relating to the broadcasting blind zone for each broadcasting channel or for each broadcasting station.

8. The method according to claim 1, further comprising informing a user of one or more broadcasting blind zones.

9. The method according to claim 1, wherein viewing digital broadcasting content comprises viewing digital multimedia broadcasting signals transmitted through a satellite, digital multimedia broadcasting signals transmitted through ground waves, or broadcasting signals transmitted through digital television broadcasting.

10. The method according to claim 1, wherein viewing the digital broadcasting content comprises viewing a predetermined channel.

11. A method for receiving broadcasting content, the method comprising:

viewing digital broadcasting content;

obtaining an original travel path based on a travel destination;

determining if a broadcasting blind zone exists relative to the original travel path;

if the broadcasting blind zone exists, selecting the original travel path or selecting a modified path that does not include the broadcasting blind zone as a selected travel path; and providing navigation data based on the selected travel path.

12. The method according to claim 11, wherein determining if the broadcasting blind zone exists comprises comparing position information relating to the broadcasting blind zone with position information of the original travel path.

13. The method according to claim 12, wherein the position information relating to the broadcasting blind zone is stored in a memory of a portable terminal.

14. The method according to claim 12, wherein the position information relating to the broadcasting blind zone is downloaded from an external source to a portable terminal.

15. The method according to claim 12, wherein the blind zone information comprises broadcasting channel information or broadcasting station information.

16. The method according to claim 15, wherein the blind zone information comprises position information relating to the broadcasting blind zone for each broadcasting channel or for each broadcasting station.

17. The method according to claim 16, further comprising informing a user of one or more broadcasting blind zones.

18. The method according to claim 11, wherein providing navigation data comprises providing voice service through a portable terminal.

19. The method according to claim 11, wherein providing navigation data comprises providing audio or visual navigation instructions relating to the navigation data to a user.

20. The method according to claim 11, wherein viewing digital broadcasting content comprises viewing digital multimedia broadcasting signals transmitted through a satellite, digital multimedia broadcasting signals transmitted through ground waves, or broadcasting signals transmitted through digital television broadcasting.

21. The method according to claim 11, wherein selecting the original travel path or the modified path that does not include the broadcasting blind zone as the selected travel path comprises prompting a user to select the original travel path or the modified travel path.

22. The method according to claim 11, wherein selecting the original travel path or the modified path that does not include the broadcasting blind zone as the selected travel path comprises a portable terminal automatically selecting the original travel path or the modified travel path.

23. A portable terminal comprising:

a broadcasting receiver configured to receive and decode digital broadcasting content;

a position information receiver configured to receive position information;

a mapping unit configured to store map information;

a video and audio processor configured to processing a video signal and an audio signal;

a display device for displaying digital broadcasting content based on the video signal;

an audio output device configured to output broadcasting content based on the voice signal;

a memory part for storing broadcasting blind zone information; and a navigation part configured to determine if a broadcasting blind zone exists on a navigation basic path while a user views the digital broadcasting content, and to provide navigation instructions for a travel path that avoids a broadcasting blind zone.

24. The portable terminal according to claim 23, wherein the memory part comprises a detachable memory device or a built-in memory device.

25. The portable terminal according to claim 23, further comprising a radio part configured to provide wireless Internet access.

26. The portable terminal according to claim 23, wherein the mapping unit comprises blind zone information, the blind zone information including broadcasting channel information or broadcasting station information.

27. The portable terminal according to claim 26, wherein the blind zone information further includes position information relating to any blind zones for each broadcasting channel or each broadcasting station.

28. The portable terminal according to claim 23, wherein the navigation part is configured to perform navigation by providing voice instructions relative to a travel path and provided to a user viewing broadcasted content.

29. The portable terminal according to claim 23, wherein the broadcasting receiver is configured to receive signals from digital multimedia broadcasting transmitted through a satellite digital multimedia broadcasting transmitted through ground waves, or digital television broadcasting.

30. The portable terminal according to claim 23, wherein the navigation part is configured to determine if the broadcasting blind zone exists for predetermined channel and while the predetermined channel viewed by a user.

31. The portable terminal according to claim 23, wherein the navigation part is configured to determine if the broadcasting blind zone exists relative to a travel path by comparing position information contained in the blind zone information stored in the memory part with position information relating to the travel path.

32. The portable terminal according to claim 23, wherein the navigation part is configured to provide at least one modified travel path enabling the receipt of digital broadcasting without the broadcasting blind zone.

33. The portable terminal according to claim 23, wherein the navigation part is configured to prompt a user to select an original travel path or a modified travel path avoiding an existing broadcasting blind zone.

* * * * *